US009643035B2

(12) United States Patent
Mastenbroek

(10) Patent No.: US 9,643,035 B2
(45) Date of Patent: May 9, 2017

(54) SAFETY DEVICE FOR A FALL RESTRAINT

(75) Inventor: Martin Mastenbroek, Bussum (NL)

(73) Assignee: KEDGE HOLDING B.V., Bussum (NL)

( * ) Notice: Subject to any disclaimer, the term of this patent is extended or adjusted under 35 U.S.C. 154(b) by 1665 days.

(21) Appl. No.: 10/584,215

(22) PCT Filed: Dec. 14, 2004

(86) PCT No.: PCT/NL2004/000869
§ 371 (c)(1),
(2), (4) Date: Jul. 24, 2006

(87) PCT Pub. No.: WO2005/061817
PCT Pub. Date: Jul. 7, 2005

(65) Prior Publication Data

US 2007/0144830 A1 Jun. 28, 2007

(30) Foreign Application Priority Data

Dec. 24, 2003 (NL) ..... 1025127
Mar. 26, 2004 (NL) ..... 1025821

(51) Int. Cl.
*E04G 1/36* (2006.01)
*A62B 35/00* (2006.01)
(Continued)

(52) U.S. Cl.
CPC ..... *A62B 35/0056* (2013.01); *A62B 35/0068* (2013.01); *A62B 35/04* (2013.01); *E04G 21/3261* (2013.01)

(58) Field of Classification Search
CPC .. A47L 3/04; A62B 1/04; A62B 35/04; A62B 35/0056; A62B 35/0068; E01F 9/0115
(Continued)

(56) References Cited

U.S. PATENT DOCUMENTS 1,883,508 A * 10/1932 Bonday ..... 248/536
2,060,953 A * 11/1936 Strom ..... E04G 7/04 182/187
(Continued)

FOREIGN PATENT DOCUMENTS

CH 271 254 A 10/1950
DE 85 31 673 U 6/1986
(Continued)

OTHER PUBLICATIONS

Zinco GmbH: "Fallnet®: das intelligente System zur Absturzsicherung" 'Online! Jun. 21, 2004 (Jun. 21, 2004), XP002324449 'Retrieved from the Internet: URL:http://www.zinco.de/aktuelles/presseberichte/pressebericht_details.php?id=8> retrieved on Apr. 12, 2005! the whole document.
(Continued)

*Primary Examiner* — Colleen M Chavchavadze
*Assistant Examiner* — Candace L Bradford
(74) *Attorney, Agent, or Firm* — Young & Thompson

(57) ABSTRACT

A safety device for a fall restraint includes an anchoring member (1) to which the fall restraint can be coupled directly or indirectly, and a fastening element for a firm and durable connection to an object (10). The fastening element is formed by a flexible fastening flap (11) which extends laterally from the device and which is intended and adapted to bring about the firm and durable connection to the object.

5 Claims, 7 Drawing Sheets

(51) Int. Cl.
*A62B 35/04* (2006.01)
*E04G 21/32* (2006.01)

(58) Field of Classification Search
USPC ..... 182/3, 45; 52/37, 166, 698
See application file for complete search history.

(56) References Cited

U.S. PATENT DOCUMENTS 2,079,768 A * 5/1937 Levow ..... 52/25
2,404,412 A * 7/1946 Stephens ..... F16B 47/00 248/205.9
3,157,256 A * 11/1964 Latta, Jr. ..... 52/166
3,307,811 A * 3/1967 Anderson ..... 248/534
4,009,763 A * 3/1977 Hunter ..... E06C 1/34 182/187
4,120,379 A * 10/1978 Carter ..... A01M 31/02 182/187
4,187,590 A * 2/1980 Harris et al. ..... 24/453
4,244,445 A * 1/1981 Strode ..... A45F 3/26 182/136
4,249,713 A * 2/1981 Glynn et al. ..... 248/237
4,467,581 A * 8/1984 Francovitch ..... E04D 5/145 411/542
4,581,863 A * 4/1986 Thaler ..... 52/126.2
4,744,187 A * 5/1988 Tripp ..... E04D 5/143 411/179
4,830,341 A * 5/1989 Arteau et al. ..... 256/65.14
4,932,185 A * 6/1990 Lebel ..... 52/704
5,105,910 A * 4/1992 Engstrom ..... A01M 31/02 182/152
5,168,684 A * 12/1992 Bruhm ..... 52/410
5,282,597 A * 2/1994 Babcock ..... 248/237
5,287,944 A * 2/1994 Woodyard ..... 182/3
5,361,558 A * 11/1994 Thornton et al. ..... 52/698
5,417,636 A * 5/1995 Havens ..... 482/145
5,687,535 A * 11/1997 Rohlf ..... A62B 35/0068 248/505
5,730,245 A * 3/1998 Conway ..... A62B 35/0068 182/3
5,829,203 A * 11/1998 Ealer, Sr. ..... 52/37
5,848,666 A * 12/1998 Woodall ..... A45F 3/26 182/187
6,227,329 B1 * 5/2001 Ador ..... 182/3
6,318,941 B1 * 11/2001 Guenther ..... 411/342
6,508,446 B1 * 1/2003 Addison ..... A47D 13/105 182/187
6,547,033 B1 * 4/2003 Cheval ..... A62B 35/0068 182/3
6,779,316 B2 * 8/2004 Carroll ..... 52/698
7,008,158 B2 * 3/2006 Madden, III ..... 411/119
8,181,743 B2 * 5/2012 duCellier ..... A01M 31/02 182/187
8,733,718 B2 * 5/2014 Corsi ..... 248/205.1
9,027,709 B2 * 5/2015 Wheelington ..... A01M 31/02 182/129
2002/0066235 A1 * 6/2002 Stearns et al. ..... 52/24
2002/0100244 A1 * 8/2002 Carroll ..... 52/698
2003/0182893 A1 * 10/2003 Poldmaa ..... 52/745.21
2006/0273600 A1 * 12/2006 Rohlf ..... A62B 35/0068 248/683
2007/0007503 A1 * 1/2007 Martinez ..... E04G 21/3214 256/59
2012/0174498 A1 * 7/2012 Anderson, Jr. ..... H01Q 1/1242 52/101
2014/0020980 A1 * 1/2014 Squires ..... A63B 27/00 182/133
2014/0224579 A1 * 8/2014 Balascak ..... E04G 21/328 182/3
2016/0128317 A1 * 5/2016 Gerry ..... A45F 3/26 248/217.3

FOREIGN PATENT DOCUMENTS

DE 201 09 056 U1 10/2001
DE 103 33 113 B3 11/2004
WO WO 02/14625 A1 * 2/2002

OTHER PUBLICATIONS

Zinco GmbH: "Die Anschlagsicherung Fallnet® SE", Internet Article, 'Online! Jun. 18, 2004 (Jun. 18, 2004), XP002324450 'Retrieved from the Internet: URL:http://www.zinco.de/systemtechnik/extensiv/sicherheit/fallnet/se_edelstahl.php> 'retreived on Apr. 13, 2005! the whole document.
Zinco GmbH: "Die Anschlagischerung Fallnet® SE" Internet Article, 'Online! Jun. 18, 2004 (Jun. 18, 2004), XP002324451 Retrieved from the Internet: URL:http://web.archive.org/web/20041016122922/www.zinco.de/systemtechnik/extensiv/sicherheit/fallnet/se_edelstahl.php> 'retrieved on Apr. 13, 2005!.

* cited by examiner

SAFETY DEVICE FOR A FALL RESTRAINT

The present invention relates to a safety device for a fall restraint, comprising an anchoring member to which the fall restraint can be coupled directly or indirectly, and comprising fastening means for a firm and durable connection to an object.

Such a device is increasingly finding application, particularly on roofs of houses and buildings as fastening point for a fall restraint with which workpeople can hook themselves during work to the roof or an outer wall of the structure in question. This is first and foremost a result of the increasingly stringent regulations in respect of working conditions in which such work may be carried out.

A safety device usually comprises a base from which a fastening eye or other anchoring member extends and which is permanently fixed to the object. An example of such a safety device is known from the American patent U.S. Pat. No. 5,287,944. The safety device described therein is fastened into the fixed construction of the object by means of a large number of screws and plugs. A corresponding number of holes are drilled for this purpose into the construction of the object at the set position. In this known safety device the fixing eyelet is formed as integral part with the base from sufficiently strong plate steel. Another example of a safety device is known from the American patent U.S. Pat. No. 5,687,535, wherein the fastening of a base thereof to the object takes place by means of one or several bolts which penetrate into the construction of the object for the purpose of a permanent fixed connection thereto. A separate fixing eyelet is in turn connected to the base by means of a nut and bolt connection.

Although these known anchoring devices provide per se a solid and reliable anchor point for a fall restraint, they also have significant drawbacks. Owing to the relatively rigid connection of the anchoring member to the construction of the object, a possible fall is not absorbed thereby, or hardly so, so that the kinetic energy involved has to be absorbed almost wholly in the fall restraint and by the falling person. Occasionally it is not possible to avoid the person suffering injury here. The attachment of the safety device in these known cases furthermore requires penetration of the object, which can have an adverse effect on the integrity of the construction thereof.

The present invention has for its object, among others, to provide a safety device of the type stated in the preamble with which these and other drawbacks are obviated to an at least significant extent.

In order to achieve the stated objective, a safety device of the type stated in the preamble has the feature according to the invention that the fastening means comprise a flexible fastening flap which extends laterally from the device and which is intended and adapted to bring about said firm and durable connection to the object. The safety device with the anchoring member is thus fastened to the object via the fastening flap. The fastening flap herein provides a certain shock absorption which can absorb at least a part of the kinetic energy in the case of a possible fall from the object, whereby personal injury is less serious.

Within the scope of the invention a wide variety of materials can in principle be applied for the flap, with solid structure or openwork net or mesh structure. However, a preferred embodiment of the safety device according to the invention has the feature that the object is covered at least locally with a flexible wall-covering material, and that the fastening flap likewise comprises a flexible wall-covering material, and in particular that the wall-covering material comprises a bituminous or plastic roof-covering material. It is noted here that within the scope of the invention the term wall should be understood in a broad sense, so that it should be understood to mean not only an outer wall but for instance also a roof of an object. Owing to its inherent flexibility, such a wall-covering material provides a high degree of shock-damping in the case of a fall, which is already broken thereby to a certain extent. The momentum exerted on the body of a falling person is therefore limited.

The choice of material for the fastening flap in the form of a material which is the same as, similar to or at least significantly compatible with the material with which the object is covered at the location, furthermore simplifies the mutual connection between the safety device and the object covering. Use is particularly made here of an attachment technique that is also used to arrange the local covering of the object. A further preferred embodiment of the safety device according to the invention has in this respect the feature that said firm and durable connection comprises a glue, fastening or welded connection. Not only is the person who normally arranges the wall covering familiar with this attachment technique, so that this person must also be deemed capable of arranging the safety device in reliable manner, such a glue, fastening or welded connection on the original covering of the object moreover leaves the integrity of the further construction thereof intact. In particular, no drill holes or other holes are therefore necessary in the wall or roof covering, which would otherwise involve the risk of leakages.

It has been found that with a sufficiently large free surface area of the fastening flap a sufficiently strong, reliable and durable connection can thus be realized. A further preferred embodiment of the safety device according to the invention has in this respect the feature that the fastening flap extends laterally on either side of, and in particular around, the device. The safety device is thus fixed to the object on either side, and in particular all-around, by means of the fastening flap, so that a possible fall can be distributed uniformly over a relatively large attachment surface.

In a further particular preferred embodiment, a safety device according to the invention has the feature that the fastening flap extends at least substantially all-around from an at least almost form-retaining, at least substantially flange-like body, and is firmly connected thereto, and that the flange-like body comprises the anchoring member. The anchoring member is herein connected to the fastening flap via a flange-like body, which enables a reliable and sufficiently strong mutual connection. The flange-like body can in principle have any random peripheral form here, but is in particular at least substantially round in order to enhance a uniform distribution of forces.

A particular embodiment of the safety device has the feature according to the invention that the flange-like body is connected to a further, at least almost form-retaining, at least substantially flange-like body while enclosing the fastening flap. In this case the fastening flap is clamped, in particular for instance freely, between the two flange-like bodies. It has been found that an effective mutual connection can thus be realized between the fastening flap on the one hand and the other part of the device on the other. A further particular embodiment of the safety device herein has the feature that at least one of the two said flange-like bodies is provided on a side directed toward the fastening flap with attaching members which extend therefrom and which penetrate into the fastening flap. The attaching members herein provide a further grip of the flange-like bodies on the fastening flap, which further enhances the mutual connection.

A further strengthening of the connection between the fastening flap and the other part of the device is realized in a further particular embodiment of the safety device according to the invention which is characterized in that both flange-like bodies are provided with a profile in a direction substantially transversely of a radial direction from a centre of the body. The profile herein provides as it were a pull relief which can effectively absorb tensile forces in the case of a possible fall. The maximum load on the mutual connection between the fastening flap on the one hand and the other part of the device on the other is thus reduced, so that the chance that the anchoring member can break loose from the fastening flap during a fall remains limited to a minimum.

In a further particular embodiment, the safety device according to the invention is characterized in that the profiles of both flange-like bodies comprise central cups which are formed thereon and which are nested in each other. The cups nested in each other herein provide the above mentioned pull relief, but moreover provide a mounting base for the anchoring member. A more particular embodiment of the safety device according to the invention is herein characterized in that both flange-like bodies are connected to each other by means of a central screw bolt with nut, wherein the screw bolt protrudes through the fastening flap and is received with the nut at least partly in the cups, and that the anchoring member is connected, or at least can be connected, to a free end of the screw bolt. By means of the screw bolt with nut, both flange-like bodies can thus be connected to each other while clamping the fastening flap therebetween. A first outer end of the bolt is herein accommodated with the nut in the cup, which enables a flat base. The anchoring member is formed, fixed or fixable to a second, free outer end of the bolt so that a fall restraint can be coupled to the anchoring member. A particular embodiment of the safety device according to the invention herein has the feature that the anchoring member is connected releasably to the screw bolt. The anchoring member can herein be exchanged as desired, subject to the type of fall restraint that has to be coupled thereto, while the remaining part of the device remains connected to the object. A further particular embodiment of the safety device according to the invention has the feature that at least one of the two flange-like bodies is provided with perforations. The perforations enhance elastic deformation of the relevant flange-like body, which enhances the process of forming for instance a cup therein. This elastic deformation moreover provides, in the case of a possible fall, for a certain shock-absorption which removes part of the forces exerted on the body of the falling person. In addition, the perforations provide, at least in a lower flange-like body, a direct contact locally between the fastening flap and a surface, which enhances mutual attachment as the occasion demands.

A further particular preferred embodiment of the safety device according to the invention has the feature that at least one of the two flange-like bodies is provided with incisions running at least substantially radially from a centre. The incisions provide the flange-like body with the possibility of deformation during a fall. This forms as it were a kind of crumple zone which will already partially absorb the forces occurring here without otherwise affecting the strength and reliability of the flange-like body. In order to avoid tearing of the fastening flap in a peripheral edge of the flange-like body during a fall, a further particular embodiment of the safety device according to the invention has the feature that a peripheral edge part of at least one of the two flange-like bodies projects to a side remote from the fastening flap.

The invention will now be further elucidated on the basis of a number of exemplary embodiments and a drawing. In the drawing.

The figures are otherwise purely schematic and not drawn to scale. Some dimensions in particular may be exaggerated to a greater or lesser extent for the sake of clarity. Corresponding parts are designated as far as possible in the figures with the same reference numeral.

Figure 1:
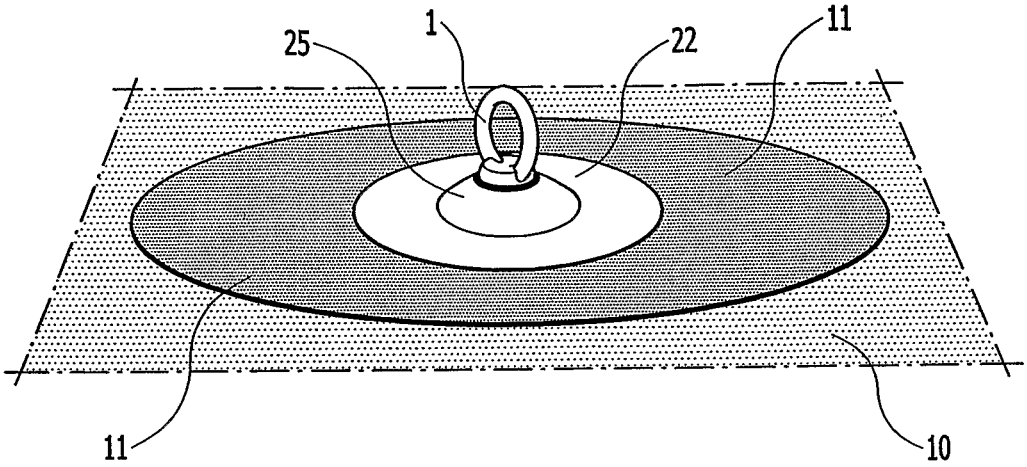
FIGS. 1-2 show a first exemplary embodiment of a safety device according to the invention.
Figure 2:
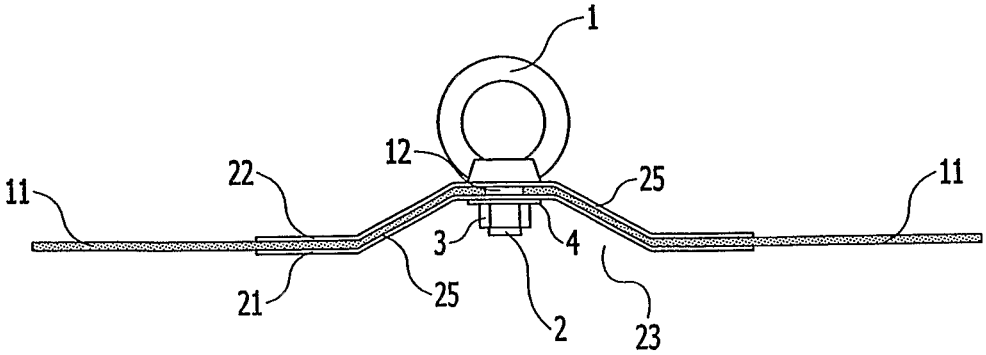

A first exemplary embodiment of a safety device for a fall restraint according to the invention is shown in FIGS. 1 and 2, respectively in perspective view and in cross-section. The device comprises a strong anchoring member 1 in the form of a fastening member formed on an outer end of a heavy screw bolt 2. In this embodiment both parts are manufactured from stainless steel. On an opposite end the screw bolt 2 is provided with a metric screw thread (M16) for receiving thereon a locking nut 3 with interposing of a washer 4. A standard fall restraint, for instance a safety line of a fall-arrest harness or safety harness, can be secured to the fixing eyelet in usual manner, for instance by means of a preferably locked karabiner hook or snap hook, in rapid and reliable manner. The device finds particular application for temporarily securing workpeople during operations at height on an object such as a house, apartment building or industrial installation. The device is herein connected permanently to the object.

For a permanent connection to the object the device is provided with fastening means in the form of a flexible fastening flap 11. This latter extends laterally from the device and with its relatively large surface area provides an attachment base for a durable fixing of the safety device to a wall or a roof of the object. In this embodiment use is made for fastening flap 11 of a flexible roof-covering material with a view to a welded connection to a like covering on the object at that location. This is more particularly a bituminous or plastic roof-covering material intended for fusing or glueing at an increased temperature to a similar roof covering such as applied on many flat roofs. The application of the safety device is not however limited to outer walls and roofs with such a type of finishing. The device can instead be for instance glued or otherwise adhered to diverse other types of roof and outer wall covering and sheeting, or be applied directly on an outer wall or roof of the object. In all cases the invention provides the option of realizing a durable and sufficiently reliable connection between the safety device on the one hand and the object or a covering thereof on the other, without affecting the integrity of the construction of the object or also without interfering therewith.

In the shown embodiment the fastening flap 11 extends all around from the other part of the device. As further shown in cross-section in FIG. 2, the fastening flap is connected to two flange-like bodies 21, 22 which fit over each other and which in this embodiment are both manufactured from strong stainless steel plate. With a view to the mutual attachment, fastening flap 11 is provided in the centre thereof with a hole or opening 12 through which protrudes the screw bolt 2 with nut 3. The fastening flap herein lies enclosed between the two flange-like bodies 21,22 which are likewise provided in their centre with a bore for passage of the screw bolt. Fastening flap 11 is clamped between the two flange-like bodies 21,22 by tightening the nut onto the screw bolt, which provides a firm and durable connection. Both flange-like bodies 21,22 are moreover provided with a profile in a direction substantially transversely of a radial direction from the centre thereof, in the form of cups 25 which are formed thereon and which are nested in each other. Such a profile provides a certain pull relief in the case of a fall, and in addition provides a cavity 23 for receiving therein the free end of bolt 2 with nut 3, so that a base of the safety device nevertheless remains flat. The elevation resulting from the cups moreover provides an external drainage which prevents the entry of rainwater.

The arranging of the safety device on for instance a flat roof provided with a bituminous roof-covering 10 can be carried out relatively simply and quickly with hardly any effect on the integrity of the original roof-covering. To this end the original roof-covering 10 is cleaned at the location and the device placed thereon with the lower flange-like body 21. Using a conventional burner or hot-air drier the bituminous fastening flap 11 is then fused at increased temperature with the existing bituminous roof-covering 10 to form the cohesive whole shown in FIG. 1. Because there is in principle no penetration here through the original roof-covering 10, the watertightness and integrity of the whole remains ensured. An auxiliary flap of bituminous roof-covering material can optionally be placed beforehand under the lower flange-like body 21 so as to create extra material here which will soften when the assembly is heated and will thus give a certain adhesion between flange-like body 21 and the roof-covering lying thereunder.

Figure 3:
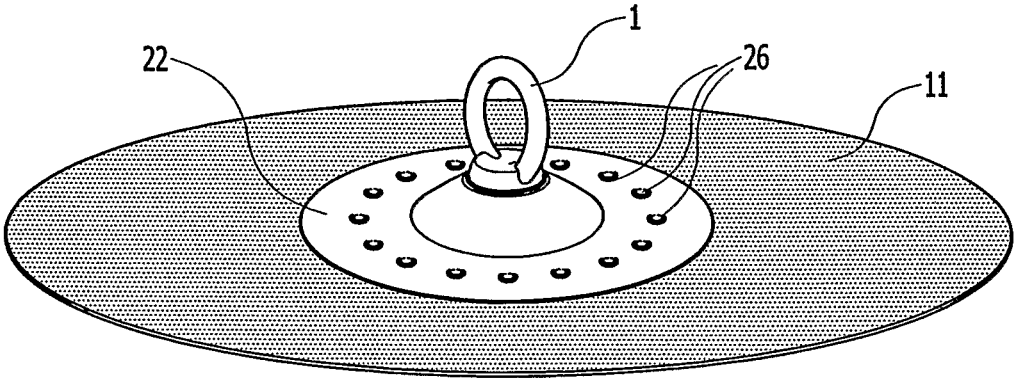
FIGS. 3-4 show a second exemplary embodiment of a safety device according to the invention, respectively in perspective view and in cross-section.
Figure 4:
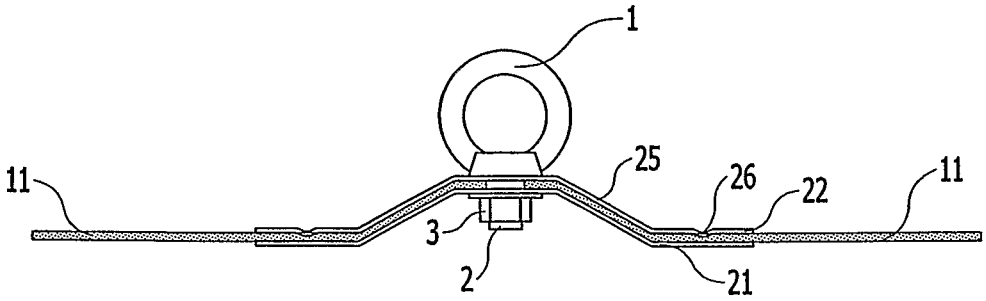

A second exemplary embodiment of a safety device according to the invention is shown in FIGS. 3 and 4, respectively in perspective view and in cross-section. This exemplary embodiment corresponds for the most part with that described above, except that in this embodiment one of the two flange-like bodies 22 is provided with protrusions, staples or nails 26 so as to exert more grip on the fastening flap 11 clamped between the two flange-like bodies 21,22. A comparable or additional extra grip can be obtained by similar protrusions, staples or nails in the other flange-like body or by roughening the surface of one or both flange-like bodies directed toward the fastening flap. Instead of or in addition to protrusions 26, one or more ridges can also be punched into one or both flange-like bodies.

Figure 5:
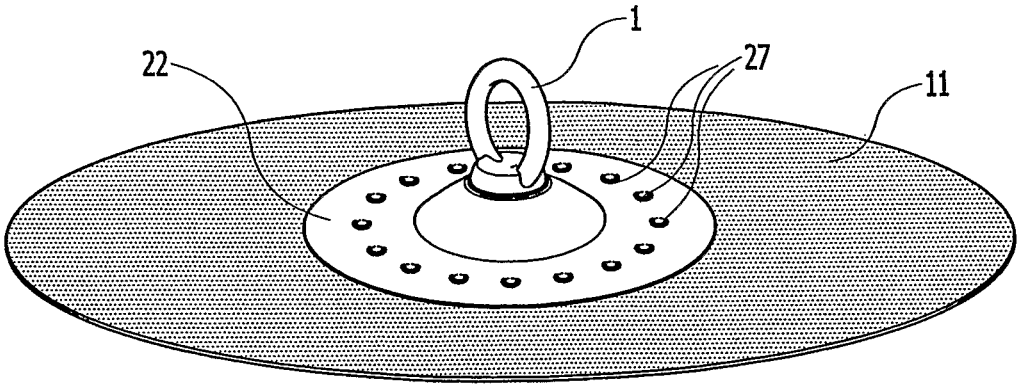
FIGS. 5-7 show respectively a first and second perspective view and a cross-section of a third exemplary embodiment of a safety device according to the invention.
Figure 6:
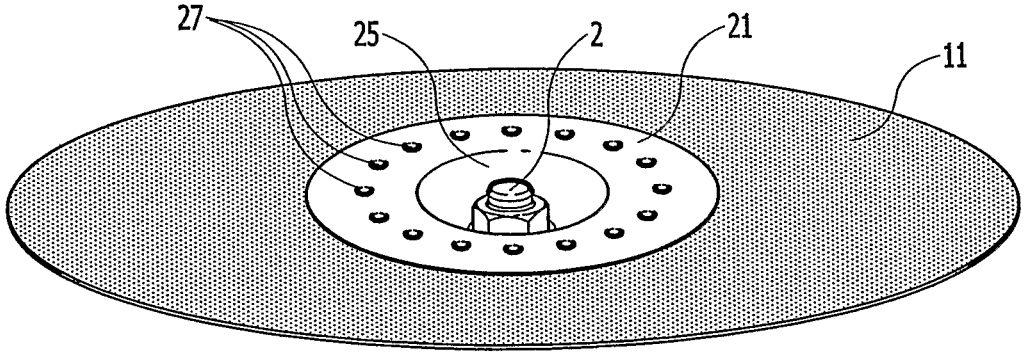
Figure 7:
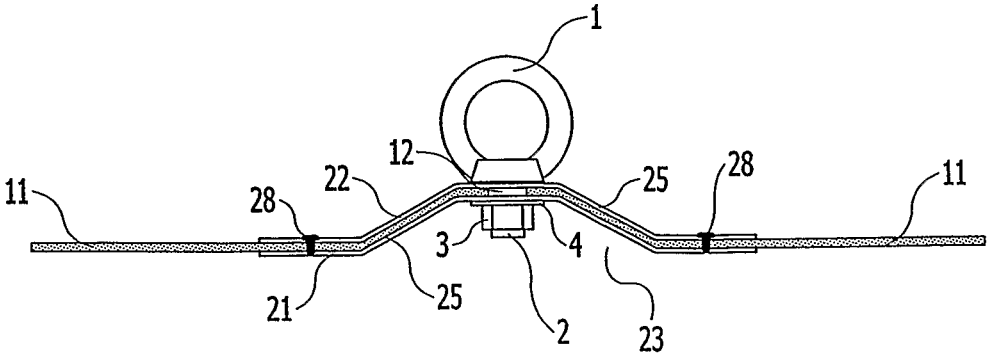

FIGS. 5, 6 and 7 show respectively a first and second perspective view and a cross-section of a third exemplary embodiment of a safety device according to the invention. In this embodiment the two flange-like bodies 21,22 are provided at corresponding positions with bores 27 for receiving therein nails 28 or other through-attaching members. FIG. 5 here shows an upper side of the device while FIG. 6 shows an underside. This embodiment otherwise corresponds to the first embodiment described above. Nails 28 are forced through fastening flap 11 from one of the two flange-like bodies and are received in the corresponding openings of the other flange-like body. The fixing of fastening flap 11 to the other part of the device can thus be realized as a permanent attachment. Use can optionally be made of shorter nails, screws or other attaching members which thereby penetrate only partially into the fastening flap so that the other flange-like body is not affected. Bores 27 or other recesses can in that case be omitted from this latter flange-like body. Instead of separate nails, nails can also be applied which are welded or otherwise fixedly connected to the relevant flange-like body.

Figure 8:
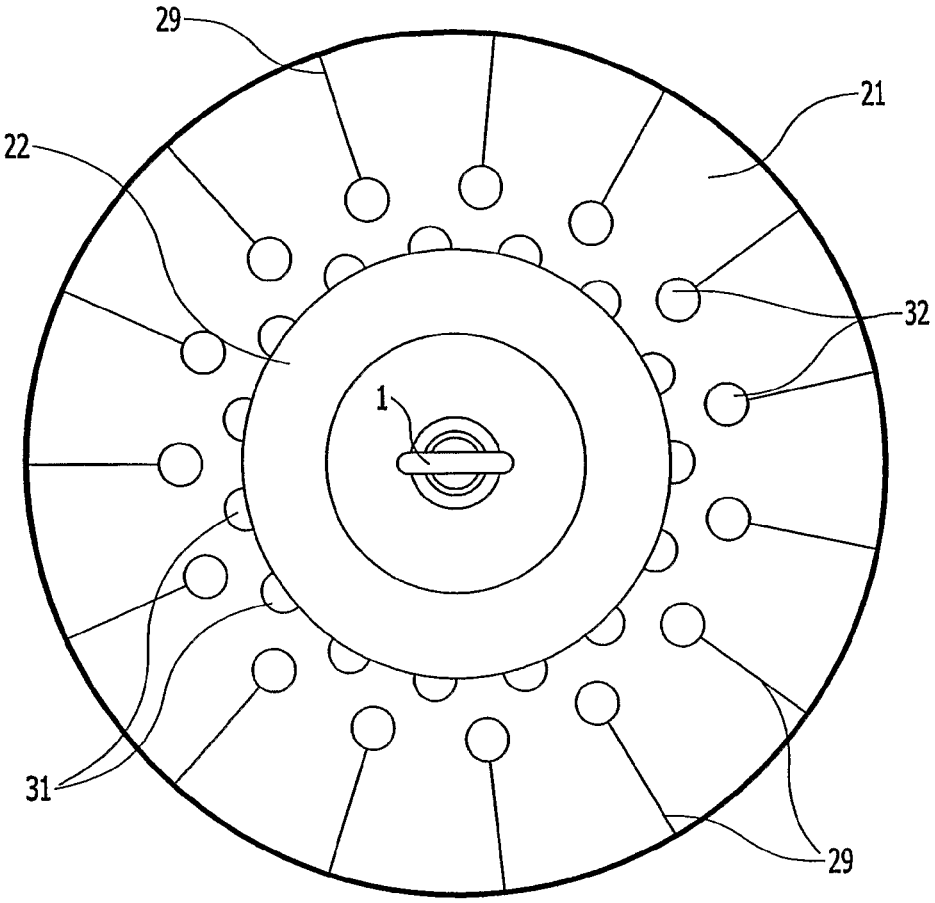
FIG. 8 shows a top view of a fourth embodiment of a safety device according to the invention.

A top view of a fourth embodiment of a safety device according to the invention is shown in FIG. 8, wherein for the sake of clarity the fastening flap, which is otherwise present, is not further shown. In this case also the device comprises two flange-like bodies 21,22 which clamp a fastening flap therebetween with which the assembly can be attached fixedly to an outer wall, roof or other wall of an object. Other than in the foregoing exemplary embodiments, the lower flange-like body 21 has a significantly larger cross-section than the upper body so as to thereby provide a larger base for the assembly. The possible forces exerted on the device during a fall are thus distributed over a larger area. The lower flange-like body 21 is also provided in this embodiment with incisions 29 running at least substantially radially from the centre thereof. These incisions allow a plastic deformation of body 21 and thus form as it were a crumple zone in the assembly. In the case of a fall the forces developing therein will result in a deformation of the body, which thereby absorbs a part of these forces. This reduces the load on the body of the falling person and thus prevents more serious injury. The upper flange-like body 22 shown here can optionally also be applied under the first flange-like body 21 so as to distribute the falling forces better over the first flange-like body 21.

In addition, at least the lower flange-like body comprises in this embodiment two rings with perforations 31,32 around the cup 25 formed thereon. These perforations enhance in the first place the forming process of cup 25, which is manufactured by being pressed from a flat plate. In particular the inner ring with perforations 31 provides this deformability. In addition, perforations 31,32 allow direct material contact between fastening flap 11 and a surface 10 at the position of flange-like body 21, which enhances the mutual attachment. Perforations 31,32 also impart a certain plastic deformability to the assembly during a possible fall, whereby as with the incisions 29 a certain shock absorption is achieved. This latter is particularly the case for the outer ring with perforations 32.

Figure 9:
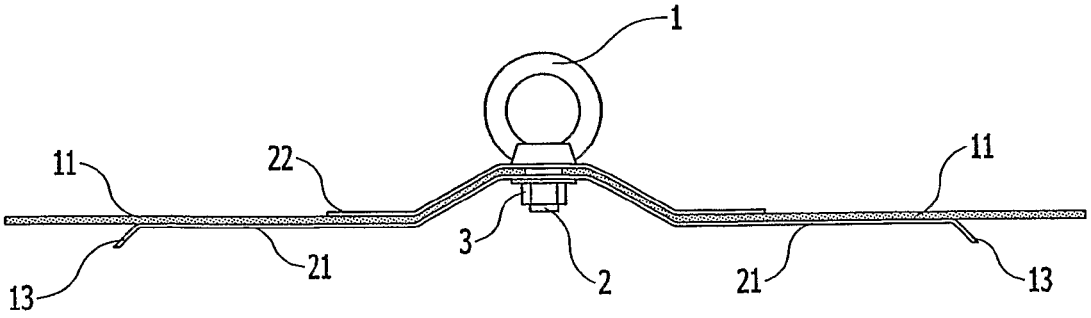
FIG. 9 shows a cross-section of a fifth embodiment of a safety device according to the invention.

FIG. 9 shows a fifth embodiment of a safety device according to the invention. In this embodiment a flexible fastening flap 11 is also clamped between two flange-like bodies 21,22, the lower 21 of which has larger dimensions. A screw bolt 2 having on an outer end a fixing eyelet 1 as anchoring member passes through the centre of an assembly and holds the assembly clampingly together due to the locking nut 3 screwed thereon. In order to avoid the fastening flap 11 tearing or being otherwise damaged on a possibly sharp edge of the lower flange-like body, a peripheral edge 13 of the lower flange-like body 21 is bent so that the edge projects toward a side remote from fastening flap 11 and cannot therefore come into contact therewith.

Figure 10:
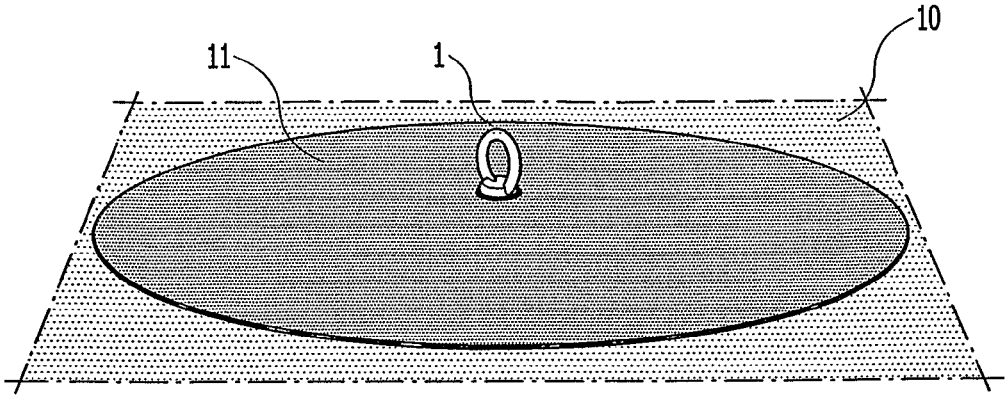
FIGS. 10-11 show a sixth embodiment of the safety device according to the invention, respectively in perspective and in cross-section.
Figure 11:
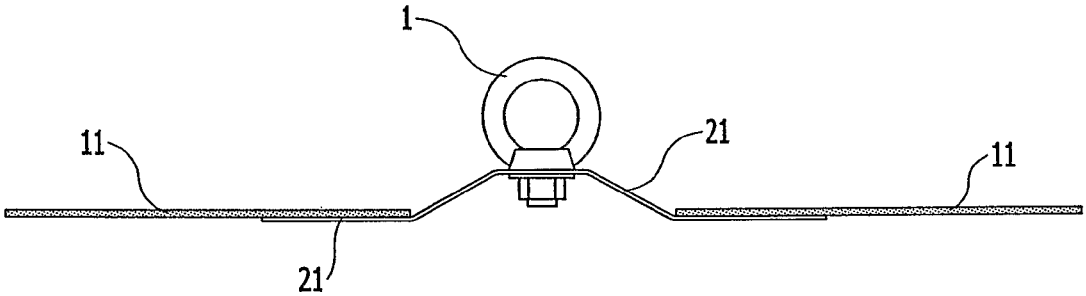

A sixth embodiment of the safety device according to the invention is shown in FIGS. 10 and 11, respectively in top view and in cross-section. Other than in the foregoing exemplary embodiments, this device comprises only one flange-like body 21 which is connected to a fastening flap 1 for instance by glueing or nailing. As in the foregoing exemplary embodiments, this flange-like body 21 provides a base for attaching an anchoring member in the form of a fixing eyelet 1 formed on a screw bolt, while fastening flap 11 is intended for glueing, welding or fusing to a surface for the purpose of a durable connection of the assembly to an object. If desired, it is also possible to make use of an anchoring member which forms an integral part with the flange-like body or is permanently connected thereto by means of welding or in other manner.

Figure 12:
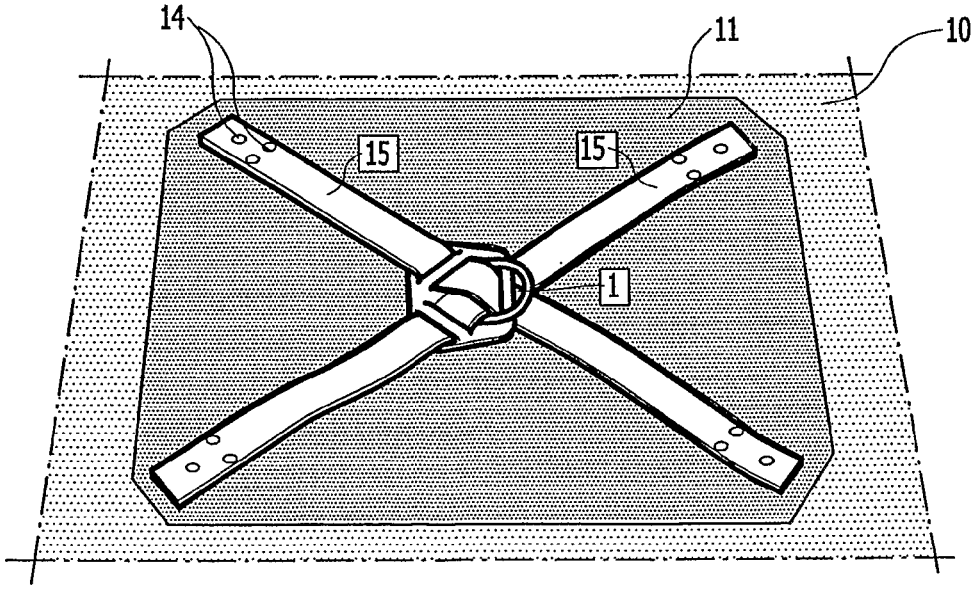
FIG. 12 shows a seventh embodiment of the safety device according to the invention in perspective.

Although the application of one or more flange-like bodies for fixing a fastening flap has been found exceptionally reliable and effective, the invention can also be embodied without such a body. A seventh exemplary embodiment of the device is an example hereof and is shown in FIG. 12. In this exemplary embodiment an anchoring member in the form of a closed ring 1 is coupled to a set of crossed straps 15. Using nails or staples 14 straps 15 are in turn connected mechanically to a flexible fastening flap 11 with which the assembly can be attached to an object 10.

Figure 13:
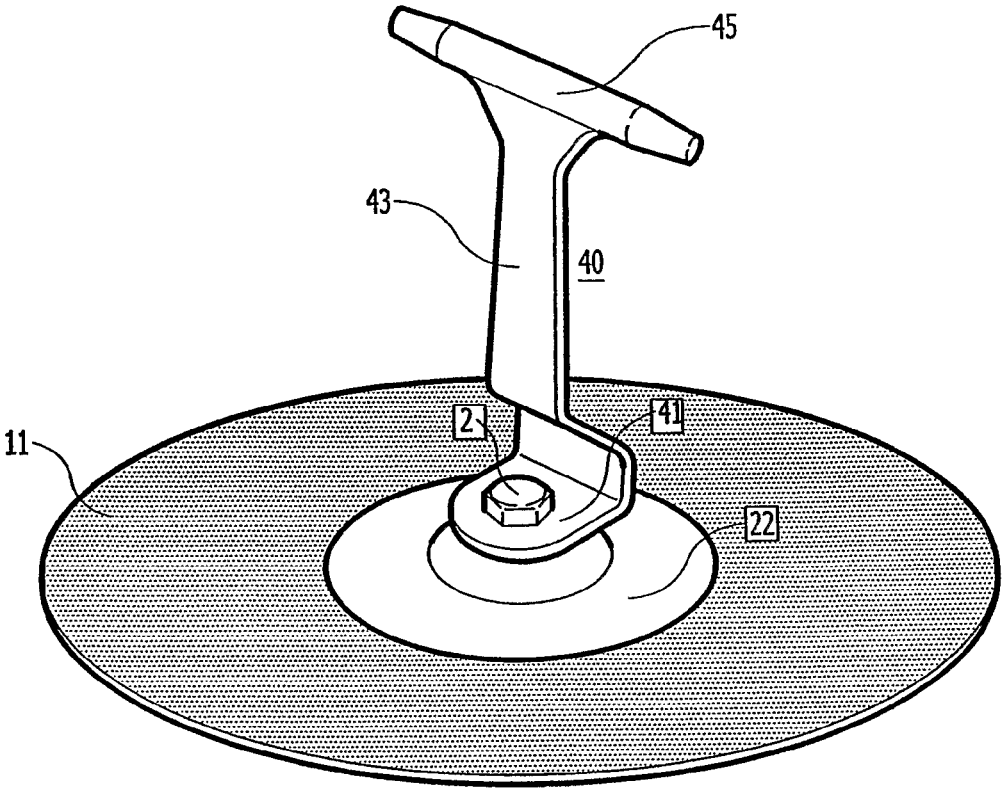
FIGS. 13-15 show an eighth embodiment of the safety device according to the invention in perspective view.
Figure 14:
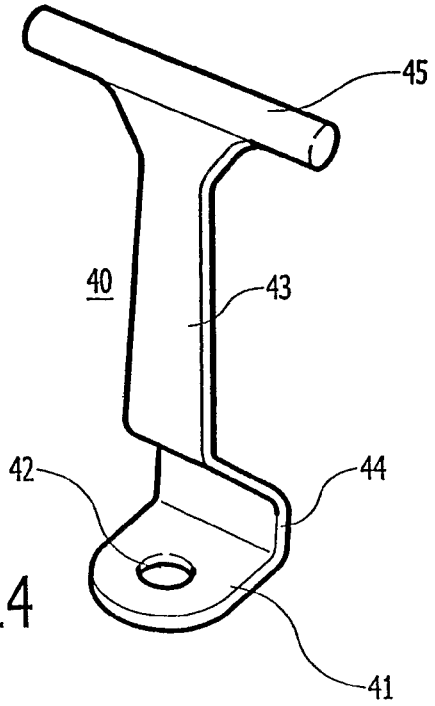
Figure 15:
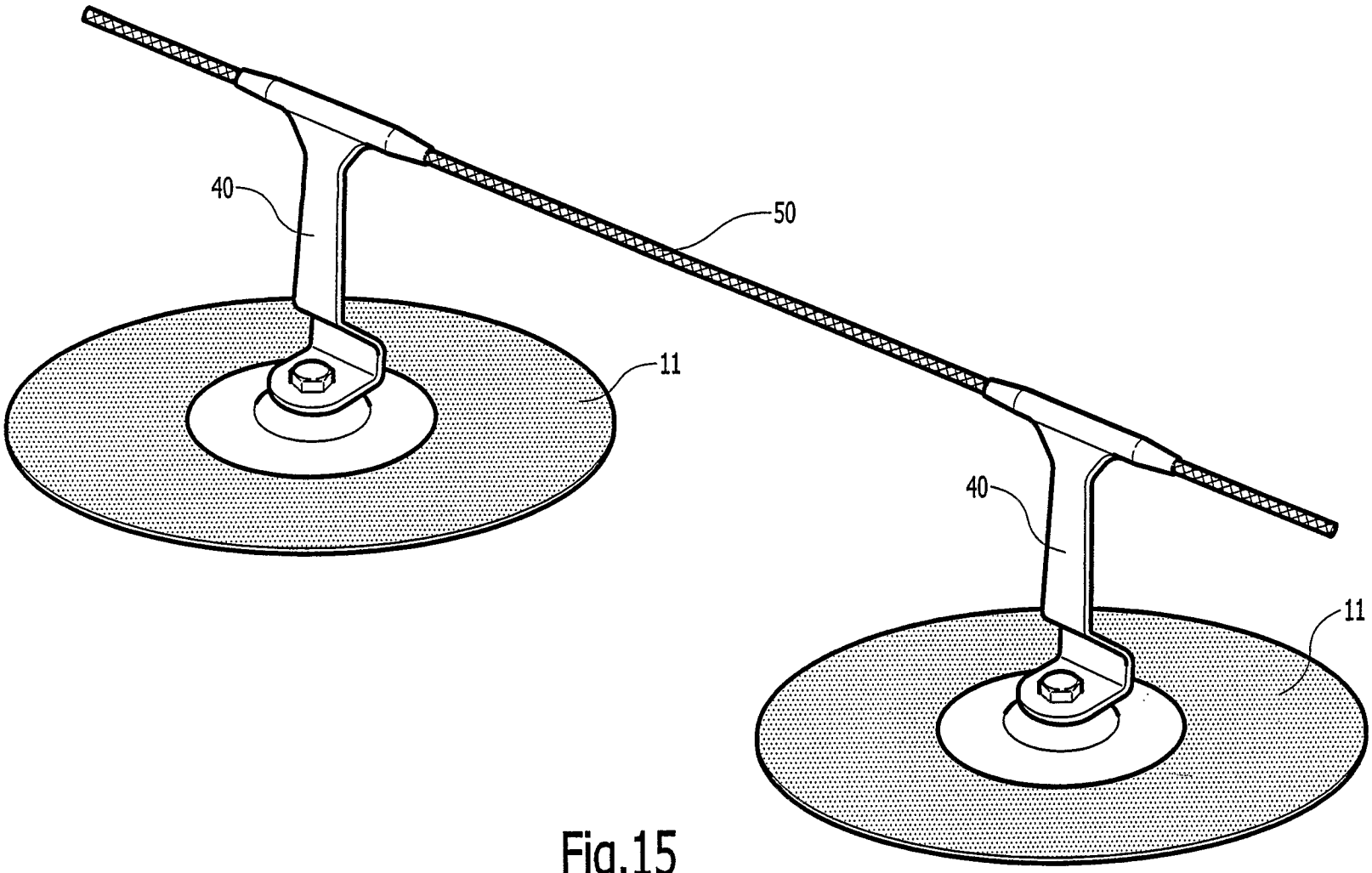

Apart from being applied as a discrete, local anchoring point, the device according to the invention can also be applied in a system of safety devices so as to arrange a more extended anchoring cable. An eighth exemplary embodiment of a safety device according to the invention which can be applied in such a system is shown in FIGS. 13-15. Use is made here of a set of two flange-like bodies as also applied in the above described exemplary embodiments of the invention, which may or may not be the same size and between which a fastening flap 11 is clamped. Instead of a central screw bolt with a fixing eyelet formed fixedly thereon, use is made in this exemplary embodiment of a screw bolt with a normal head. In addition to serving for the mutual attachment of the flange-like bodies 21,22 and fastening flap 11, this bolt also serves to fix a separate anchoring member 40 in the form of a cable bushing or cable guide for a safety cable 50, see also FIGS. 14 and 15.

The anchoring member 40 applied here comprises a flat base 41 with an upright 43 which extends therefrom and has a bent portion 44 close to the base. Base 41 comprises a central opening 42 into which fits the central bolt 2 with which anchoring member 40 is fastened to the other part of the device. Mounted on a free end of upright 43 is a hollow tube 45 through which safety cable 50 can be guided. Hollow tube 45 can take a straight form, see FIG. 14, but preferably narrows at either side, see FIG. 13, in order to effectively guide a so-called sliding carriage over safety cable 50 during use.

The anchoring member is manufactured wholly from strong, impact-resistant material. In this embodiment stainless steel is applied for this purpose, wherein base 41 and upright 43 are formed from plate steel with a thickness in the order of 4-6 mm, while the hollow tube is welded thereon. Instead of such mutually connected parts, it is also possible, depending on the chosen starting material, to apply an integral anchoring member which is then formed for instance as a casting.

A number of such safety devices can be applied to guide a safety cable over a desired length in a desired path, see FIG. 15. The various safety devices are herein connected in the above described manner to a surface, or a bituminous roof-covering, by means of the flexible fastening flap. Safety cable 50 is generally received freely in the intermediate devices and attached fixedly to the outermost device. A person who goes onto a roof or to other high position where such safety devices are arranged can secure himself by means of a harness, lifeline and sliding carriage to anchoring member 50, and then has complete freedom of movement along the safety cable.

In the case of a possible fall from the roof, a tensile force is in the first instance exerted on safety cable 50 via a lifeline of the harness. Owing to the height of safety cable 50 above the base 41 of anchoring member 40, caused by the height of uprights 43, this produces a considerable moment relative to this base. Owing to the pre-bent design of upright 43, this results in a controlled bending of the uprights which thereby absorb a part of the kinetic energy, while the fastening of anchoring members 40 to the other part of the device is moreover spared. Through folding down of uprights 43 the tensile force will be directed parallel to the roof surface, whereby it can be resisted in optimal manner.

The device according to the invention can in principle be applied on any structural type of roof or outer wall construction, wherein the strength of the construction is of secondary importance. Examples hereof are roof coverings or wall claddings of bitumen or plastic which are wholly or partially adhered, mechanically fixed or ballasted with loose material. The application of the safety device according to the invention complies with the EN 795 standard known to the skilled person. This standard describes the requirements for the testing methods for anchor provisions intended for personal protection against falls. The two essential points from the EN 795 standard are:

- a static test wherein a force of 10 kN can be resisted for 3 minutes in the direction in which the force can be applied during use; and
- a dynamic test wherein a mass of 100 kg, connected to the anchor point with a steel cable, is stopped in a free fall of 2500 mm.

Although the invention has been further elucidated above on the basis of only a number of exemplary embodiments, it will be apparent that the invention is by no means limited thereto. On the contrary, many variations and embodiments are still possible within the scope of the invention for a person with ordinary skill in the art. The different embodiments of the safety device for fall restraint according to the invention have in common that they are lightweight and can be mounted rapidly with simple means and tools. Specific to this safety device is that the force released during a fall is absorbed in elastic manner by the materials from which the device is manufactured. When the occasion demands, a plastic deformation of one or more components of the device will absorb a significant part of the kinetic energy of a fall. The forces are then transmitted to the existing covering of the roof or the outer wall or to the roof or the outer wall itself.

The invention claimed is:

1. A anchoring device for a personal fall protection restraining a person from falling from an elevated surface of an object, said anchoring device comprising:

- an anchoring member for securing said personal fall protection, directly or indirectly,
- fastening means that, during use, provide a firm and reliable connection of said anchoring device to said object, and
- a substantially flat, substantially rigid body that comprises said anchoring member,
- wherein said fastening means comprise a flexible fastening flap that extends laterally from said rigid body and that is, during use, glued, welded, fused or otherwise adhered without a penetrating mechanical fastener to an exposed surface of said object to create a physical bond with said elevated surface in order to provide said reliable connection of said anchoring device to said object, wherein said substantially flat, rigid body comprises a flange-shaped first member and a flange-shaped second member that enclose a portion of said flexible fastening flap therebetween to form said anchoring device as a pre-formed assembly that is ready to be adhered to the object by means of said flexible fastening flap.

2. The anchoring device according to claim 1, wherein at least one of said flange-shaped first member and said flange-shaped second member is provided at an inner side with attaching members which extend into said flexible fastening flap.

3. The anchoring device according to claim 1, wherein said flange-shaped first member and said flange-shaped second member are provided at their centre with cup-shaped profiles which are nested into each other.

4. The anchoring device according to claim 3, wherein said flange-shaped first member and said flange-shaped second member are mutually connected by means of a central screw bolt with nut, said screw bolt protrudes through said flap and is received together with said nut at least partly in the cups, and the anchoring member is connected, or at least connectable, to a free end of the screw bolt.

5. The anchoring device according to claim 4, wherein the anchoring member comprises a fixing eyelet which is connected releasably to the screw bolt.

* * * * *